United States Patent [19]

Druschel

[11] 4,218,902

[45] Aug. 26, 1980

[54] PROTECTIVE COVER FOR SHACKLE LOCK

[76] Inventor: William O. Druschel, Raemont Rd., Granite Springs, N.Y. 10527

[21] Appl. No.: 922,792

[22] Filed: Jul. 7, 1978

[51] Int. Cl.[2] ..... E05B 67/38

[52] U.S. Cl. ..... 70/55

[58] Field of Search ..... 70/55, 54, 56, 38 R, 70/38 A, 38 B, 38 C, 51, 53; 74/566; 277/135; 220/4 B; 150/52 R

[56] References Cited

U.S. PATENT DOCUMENTS

| | | | |
|---|---|---|---|
| 2,062,748 | 12/1936 | Golden | 74/566 |
| 3,285,093 | 11/1966 | Sellmeyer | 74/566 |
| 3,762,592 | 10/1973 | Mayes | 220/4 B |
| 3,858,419 | 1/1975 | Hampton | 70/55 |

*Primary Examiner*—Robert L. Wolfe

*Attorney, Agent, or Firm*—Price, Heneveld, Huizenga & Cooper

[57] ABSTRACT

A protective cover for a shackle lock is integrally made of a resilient material having an upper surface with a pair of spaced apertures defined by ring seals integrally molded to the top and surrounded by an accordian fold. Downwardly depending sidewalls fit over the body of a shackle lock and terminate with a peripheral bead adapted to sealably engage a bottom plug having a corresponding recess such that when the plug is fitted into the open bottom a tight seal is formed. In the preferred embodiment, a tether is coupled to the bottom and is detachably secured to one of the walls of the cover. The accordian fold surrounding the spaced apertures permits the apertures to align with shackle bars of a variety of lock sizes while the ring provides a tight seal against the shackle bar preventing entry of vapors, dirt, moisture, and the like.

11 Claims, 3 Drawing Figures

PROTECTIVE COVER FOR SHACKLE LOCK

BACKGROUND OF THE INVENTION

The present invention relates to a protective cover for a shackle type lock.

Shackle locks commonly known as padlocks of either the combination or key type, are frequently exposed to environments which either greatly shorten their life or render them difficult to operate. Even when frequently lubricated, such locks when used outdoors and exposed to weathering, are typically difficult to operate. In harsher environments, such as in factories or the like where corrosive atmospheres can attack the locks or where the locks are subject to dust and other harmful particulate materials, the lock life and operation is even more severely affected.

Naturally, manufacturers have attempted to make locks of materials tending to resist normal weathering but oxide coatings still form on the locks and/or particulate materials enter the locks causing difficulty of operation.

A variety of protective covers for locks have been proposed by the prior art. Representative of such protective covers are U.S. Pat. Nos. 1,662,612, issued Mar. 13, 1928, to J. Junkunc; 2,375,488, issued May 8, 1945, to C. E. Olson; 3,848,440, issued Nov. 19, 1974, to L. Manuel; and 3,858,419, issued Jan. 7, 1975, to M. Hampton. Although such prior art discloses covers or other sealing means adapted to protect to some extent shackle type locks, the prior art does not provide improved sealing around the shackle bars themselves, or flexibility for accommodating different lock sizes or other features and advantages of the present invention.

SUMMARY OF THE INVENTION

The present invention comprises an integral protective cover having a top with a pair of spaced shackle receiving apertures, the periphery of which include a reinforcing ring surrounded by an accordian fold and downwardly depending sidewalls terminating in a peripheral rim. A removable plug is inserted from the bottom and includes a channular groove adapted to fit within the sidewalls and snappably receive the bead in sealing engagement. In one embodiment, the bottom plug includes a tether adapted to attach to fastening means provided on one of the sidewalls.

Such construction provides a variety of advantages permitting, for example, use of a less expensive lock to be used in environments for which it would otherwise not be suitable. Also, the cover can be oversized to some extent or the bottom plug can be hollowed out to define a void to accommodate storage of desiccant material or a neutralizing material to a corrosive atmosphere in which the lock is employed. The cover also serves to provide electrical insulation for a metal lock if used in association with electrical equipment as well as provide noise buffering where the lock is subject to vibration and contact against the article with which it is employed.

The cover can be manufactured of a variety of colors and a lock system can thereby be color keyed using different colors for locks identifying a particular use. Additionally, the plug can be made of a low density core material and coated to provide floatation for the lock if used in a marine environment. By sealing the lock and therefore protecting it from the environment, also lubricating materials used in the lock are also sealed within the cover providing longer maintenance free operation of the lock. By selecting a dark color for the cover, a lock used in cold environments can be warmed by absorption of the sun's rays to prevent freezing of the lock.

These and other features and advantages of the invention can best be understood by referring to the following description thereof together with the drawings in which:

DETAILED DESCRIPTION OF THE PREFERRED EMBODIMENT

Figure 2:
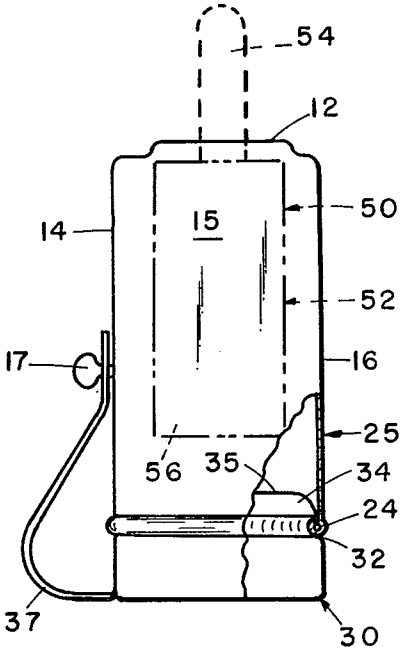
FIG. 2 is a right side elevation partly broken away of the structure shown in FIG. 1.
Figure 3:
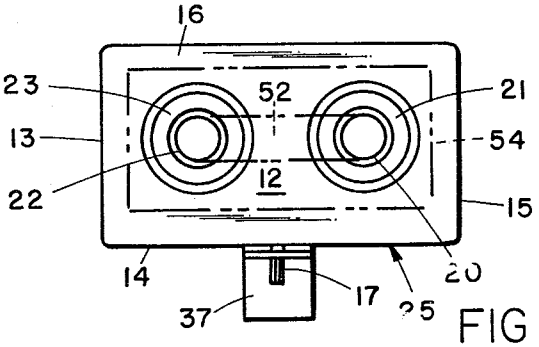
FIG. 3 is a top plan view of the structure shown in FIG. 1.

Referring now to the FIGS., there is shown a protective cover 10 for a lock 50 of the shackle type and which includes a body 52 and a shackle 54. It is understood that one end of the shackle 54 is removable from the body of the lock and pivots about the remaining end of the U-shaped shackle for opening or closing the lock. The bottom 56 of the lock typically includes a key receiving slot or numbered tumblers of a combination lock. In some cases, the combination tumbler will be on the side of the lock body.

Figure 1:
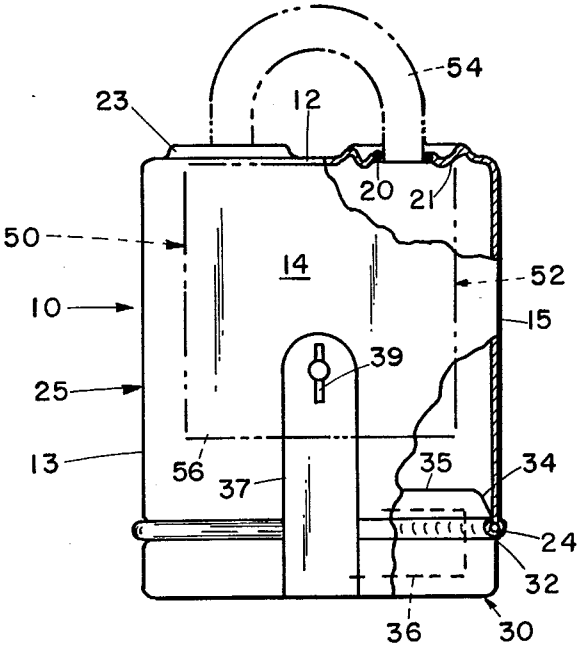
FIG. 1 is a front elevational view partly broken away of the present invention.

Surrounding and sealably encapsulating lock 50 is the protective cover 10 which includes a body 25 and plug 30. The body has a top 12 and integral downwardly depending sidewalls including a front wall 14, rear wall 16, and left and right sidewalls 13 and 15, respectively. The top 12 includes a pair of spaced circular apertures defined by circular sealing rings 20 and 22 which are integrally formed in the top wall of the cover and which define O-ring type seals around the shackle 54 which has a circular cross section. The apertures defined by rings 20 and 22 are preferably slightly smaller in diameter than the shackles to provide a snug sealing engagement with the exterior surface of the shackle. Surrounding each ring 20 and 22 and the remainder of top wall 12 is a flexible web or corrugation defining accordian folds 21 and 23 which is best seen in FIG. 1 and which permits lateral movement or displacement of rings 20 and 22 (in the horizontal direction as viewed in FIG. 1) to accommodate for shackles having different spacings between the ends. Folds 21 and 23 also permit vertical movement of rings 20 and 22 such that the captured end of the shackle when moved to and away from the body of the lock will remain in place on the shackle and remain sealed instead of sliding within the ring. Naturally, the free end of the shackle is removed from the ring seal for use of the lock. The folds 21 and 23 also permit enlargement of rings 20 and 22 to accommodate different shackle diameters.

As seen in the FIGS., the sidewalls of body 25 are of a dimension to provide a space around the lock for using a single cover for a variety of lock sizes. Near or at the lower end of the sidewalls of body 25 is an integral circular bead 24 which, like rings 20 and 22, is integrally formed with the body and which compressively engages a bottom plug 30. Plug 30 includes a peripheral channel 32 having a semi-circular cross section as best seen in FIGS. 1 and 2 for receiving bead 24.

Plug 30 also has a tapered camming surface 34 extending around the upper end 35 of the plug to facilitate insertion of the plug within the open bottom of cover body 25.

Plug 30 can, as best seen in FIG. 1, be formed of a low density core member 36 subsequently coated by a resilient polymeric material from which the body 25 of cover 10 is also made.

Plug 30 can also include a downwardly depending opening through top surface 35 extending into the space shown as core 36 in FIG. 1 to define a pocket for receiving materials such as a desiccant, a neutralizing material for a corrosive atmosphere in which the lock is employed, keys to another lock in a lock system or instructions in the form of a code for the lock combination if a combination lock is employed.

In the embodiment shown, integral with plug 30 is a tether 37 extending from the center of the front and bottom corner upwardly to engage a snap post 17 formed on and extending outwardly from front wall 14 of body 25. The tether 37 includes a slot 39 for snapping the tether to post 17. Thus, when the plug is removed from the bottom of the lock cover for opening the lock, it will remain attached to the body 25.

The lock cover body 25 preferably is made of a resilient material and can be a natural or synthetic rubber or a resilient polymeric material. A variety of materials are suitable such as a vinyl polymeric material including PVC. The low density plug core material 36 may include, for example, expanded urethane, sponge rubber, cork, or the like to render the assembly buoyant. The thickness of the cover as well as its particular size can vary for a given application but a thickness of at least 1/32 inch is desirable. By making the cover body somewhat larger than the lock body, as seen in FIGS. 1 and 2, should the cover become coated with ice or the like, it can be easily removed by flexing the resilient cover.

The cover is installed initially on the lock by extending the free end of shackle 54 from the inside of body 25 outwardly through one of the rings 20 and 22 and then placing the body of the lock within the protective cover such that the free end of the shackle can then project downwardly into the remaining aperture. Plug 30 is inserted by rolling ring 24 into channel 32 with the tapered camming surface 34 facilitating its insertion. To gain access of the lock, the removable plug 30 is simply pulled downwardly from the sidewalls of the cover body and the bottom surface 56 of the lock is directly accessible for receipt of a key, or if a combination lock, with bottom tumblers. If the lock is a combination with the combination tumblers on the sidewall of its body, the resilient cover permits the walls to be moved upwardly to gain access to the tumbler.

It will become apparent to those skilled in the art that various modifications to the present invention can be made without departing from the spirit or scope thereof as defined by the appended claims.

The embodiments of the invention in which an exclusive property or privilege is claimed are defined as follows:

1. A protective cover for a shackle type lock comprising:

a body having a one-piece, integral top and downwardly depending side walls defining a lock encompassing enclosure with an open bottom, said top including a pair of spaced apertures formed through said top and defined by ring seals integral with said top, and an accordian fold surrounding each of said ring seals to permit linear and rotational flection therebetween, said enclosure top and side wall being resilient to permit lateral displacement of said ring seals to accommodate variously sized locks, and permit flexing of said side walls to facilitate assembly of a lock in said integrally formed enclosure, and to provide access to side mounted lock tumblers; and a closure shaped to sealably fit within the open bottom of said enclosure.

2. The cover as defined in claim 1 wherein said side walls include a bead extending around the periphery thereof near said open bottom.

3. The cover as defined in claim 2 wherein said closure comprises a plug including a channel for sealably receiving said bead for securing said plug within said open bottom of said enclosure.

4. The cover as defined in claim 3 wherein said plug includes a tapered upper end facilitating insertion of said plug into said open bottom of said enclosure.

5. The cover as defined in claim 4 and further including a tether coupling said plug to said side walls.

6. The cover as defined in claim 1 wherein said closure comprises a plug having a core of low density material coated with a resilient material.

7. The cover as defined in claim 1 wherein said side walls have a length which extends beyond a lock for use with said cover to define a cavity between the lock and said closure.

8. The cover as defined in claim 7 wherein said closure has a core of sufficiently large volume low density material to provide floatation of said cover and a lock therein.

9. The cover as defined in claim 8 and further including a detachable tether extending between said body and said closure.

10. The cover as defined in claim 1 wherein said resilient material is of a color to absorb radiation from the sun.

11. The cover as defined in claim 1 wherein said resilient material is an electrical insulator.

* * * * *